US008049683B2

(12) United States Patent
Sugimoto

(10) Patent No.: US 8,049,683 B2
(45) Date of Patent: Nov. 1, 2011

(54) DRIVING CIRCUIT FOR A DISPLAY PANEL AND A DISPLAY HAVING SAME

(75) Inventor: Terukazu Sugimoto, Chiba-ken (JP)

(73) Assignee: Futaba Corporation, Chiba-Ken (JP)

( * ) Notice: Subject to any disclaimer, the term of this patent is extended or adjusted under 35 U.S.C. 154(b) by 668 days.

(21) Appl. No.: 12/232,110

(22) Filed: Sep. 11, 2008

(65) Prior Publication Data

US 2009/0066260 A1 Mar. 12, 2009

(30) Foreign Application Priority Data

Sep. 12, 2007 (JP) ..... 2007-236450

(51) Int. Cl.

| | |
|---|---|
| ***G09G 3/20*** | (2006.01) |
| ***G09G 3/22*** | (2006.01) |
| *G09G 3/10* | (2006.01) |
| *G09G 3/30* | (2006.01) |

(52) U.S. Cl. ..... 345/75.2; 345/76; 345/77; 315/169.1; 315/169.3

(58) Field of Classification Search ..... 345/45, 345/75.2

See application file for complete search history.

(56) References Cited

U.S. PATENT DOCUMENTS

2005/0035957 A1 * 2/2005 Lin et al. ..... 345/204

FOREIGN PATENT DOCUMENTS

EP 1589517 A2 * 10/2005

* cited by examiner

*Primary Examiner* — Douglas W Owens
*Assistant Examiner* — Dedei K Hammond
(74) *Attorney, Agent, or Firm* — Bacon & Thomas, PLLC

(57) ABSTRACT

There is provided a driving circuit capable of driving current flowing in cathode electrodes with high accuracy and displaying without brightness variation. For driving a cathode electrode in a display panel, a first current mirror circuit is fabricated by connecting a gate of first FET and a gate of second FET and a second current mirror circuit is fabricated by connecting a gate of a third FET connected in series to the second FET and a gate of a fourth FET. A brightness signal controls the magnitude of current flowing in the first FET, so that the current flowing to the cathode electrode via the fourth FET can be controlled with high accuracy.

6 Claims, 12 Drawing Sheets

DRIVING CIRCUIT FOR A DISPLAY PANEL AND A DISPLAY HAVING SAME

FIELD OF THE INVENTION

The present invention relates to a driving circuit for a display panel and a display having same.

BACKGROUND OF THE INVENTION

With a recent trend toward a thin display, a display using a field emission device (hereinafter, referred to as "FED") and a display using an organic electroluminescent (hereinafter, referred to as "EL") device are expected to be widely applied as displays for household and industrial use. In these displays, display devices are arranged in a two-dimensional space to form a display panel, and the display panel thus formed is driven by a driving circuit. Although a driving circuit for the FED is different in circuit parameters from a driving circuit for the EL device, both have a common driving principle. In the following description, a driving circuit for the FED will be mainly explained. However, this description can also be applied to the EL device.

In the FED, electrons are emitted through a tunnel effect from a metal surface or a semiconductor surface of which electric field strength is about $10^9$ V/m. FIG. 10 is a cross sectional view of a spindt type FED. This FED is fabricated by forming on an insulating substrate 100 a cathode electrode 101, a gate electrode 102 and a molybdenum cone-shaped emitter 103 electrically connected to the cathode electrode 101, each of which is formed of a conductive material. Further, an $SiO_2$ film is formed between the cathode electrode 101 and the gate electrode 102 to insulate them from each other and maintain a predetermined distance therebetween.

Moreover, in order to capture electrons emitted from the FED, an anode electrode 104 coated with phosphor is disposed in a position separated with a gap from the gate electrode. When a gate-cathode voltage $V_{GC}$ is applied between the cathode electrode 101 and the gate electrode 102, electrons are emitted. Further, an anode voltage $V_A$ is applied between the cathode electrode 101 and the anode electrode 104, so that the electrons emitted from the emitter 103 collide with the phosphor of the anode electrode 104 to thereby emit light. At this time, a cathode current Ic flows between the anode electrode 104 and the cathode electrode 101.

FIG. 11 illustrates a cathode current Ic as a function of (a gate-cathode voltage $V_{GC}$ of a spindt type FED. When the gate-cathode voltage $V_{GC}$ is greater than a threshold value $V_{TH}$, the cathode current Ic starts to flow. As the gate-cathode voltage $V_{GC}$ increases, the cathode current Ic increases. The increase in the cathode current Ic leads to the increase in the amount of light emitted from the phosphor. Therefore, the amount of light emitted from the phosphor can be controlled by controlling the gate-cathode voltage $V_{GC}$. $V_{OP}$ and $I_{OP}$ in the figure represent operation $V_{GC}$ and Ic.

FIG. 12 depicts an equivalent circuit of the spindt type FED shown in FIG. 10. A resistance Rc indicates a resistance between the cathode electrode 101 and the emitter 103. As shown in FIG. 12, a pulse voltage $V_C$ is applied to the cathode electrode 101 (not shown in FIG. 12) connected to the resistance Rc, and a pulse voltage $V_G$ is applied to the gate electrode 102. Depending on the combination of the pulse voltage $V_C$ and the pulse voltage $V_G$ applied, the gate-cathode voltage $V_{GC}$ is controlled, so that the electric field emission can be controlled.

FIG. 13 schematically shows a part of a display panel forming a display by using FEDs as display devices arranged in a two-dimensional space. In the display panel, a plurality of cathode electrodes and a plurality of gate electrodes are arranged in a matrix shape to intersect with each other. The $SiO_2$ layer shown in FIG. 10 is omitted in FIG. 13 for the sake of simplicity. Although only cathode electrodes $\mathbf{101}_1$ to $\mathbf{101}_3$ and gate electrodes $\mathbf{102}_1$ to $\mathbf{102}_3$ are illustrated in FIG. 13, the numbers of cathode electrodes and gate electrodes are properly determined depending on the use. An FED having, e.g., nine emitters, is formed at each intersection point of the cathode electrodes with the gate electrodes.

FIG. 14 provides a conceptual diagram for explaining how to drive the display panel by a driving circuit 120. Here, high levels of the pulse voltage $V_G$ and the pulse voltage $V_C$ generated by the driving circuit 120 are respectively set to about 50 V and 30 V, and low levels thereof are set to 0 V. Since a voltage difference between the pulse voltage $V_G$ and the pulse voltage $V_C$ is applied as a gate-cathode voltage $V_{GC}$ to each FED, four gate-cathode voltages $V_{GC}$ of 50 V, 20 V, 0 V and −30 V can be applied to each FED corresponding to a single dot (hereinafter, one or more emitters disposed at each intersection point are referred to as a "dot").

When a threshold value is set to be greater than 20 V, e.g., 30 V, electrons are emitted only from dots to which a gate-cathode voltage $V_{GC}$ of 50 V is applied. For instance, in the example of FIG. 14, electrons are emitted only from dots positioned at the intersection point of the gate electrode $\mathbf{102}_3$ and the cathode electrode $\mathbf{101}_1$ and that of the gate electrode $\mathbf{102}_3$ and the cathode electrode $\mathbf{101}_3$. Accordingly, light is emitted only from the phosphors corresponding to the dots. The hatched dots in FIG. 14 correspond to those from which electrons are emitted. Further, in order to adjust emission brightness, the pulse voltage, e.g., $V_C$ or $V_G$ is adjusted such that the gate-cathode voltage $V_{GC}$ is set to be greater than or equal to the threshold voltage (e.g., 30 V) and correspond to the desired emission brightness. Moreover, a voltage of about 3 KV with respect to the cathode electrode is applied to the anode electrode (not shown in FIGS. 13 and 14) coated with phosphor.

The above description on the FED can also be applied to an EL, even though the EL does not include gate electrodes, by forming a panel structure in which cathode electrodes and anode electrodes corresponding to gate electrodes of the FED are made to intersect with each other and distributing potentials between the anode electrodes and cathode electrodes of the EL in a similar way as in $V_{GC}$ of the FED.

In accordance with the above method, it is possible to control electron emission from dots by controlling voltages of the gate electrodes and the cathode electrodes arranged in a matrix shape. However, the above method has following drawbacks. FIG. 15 shows a comparison between characteristics obtained when accumulated operation time is short (initial characteristics) and those obtained when accumulated operation time is long (after-use characteristics). The current emission performance of the emitter deteriorates due to use for a long period of time. Thus, even if the gate-cathode voltage $V_{GC}$ is set to be the same, lower cathode current Ic flows when the accumulated operation time is long compared to the case when the accumulated operation time is short. Further, since almost no current flows from the cathode electrode to the gate electrode, a magnitude of cathode current of an FED corresponding to a current contribution from a single dot is substantially the same as that of anode current.

FIG. 16 compares current emission performances from different dots in the display panel of the display. In FIG. 16, curved lines indicated as dots A to C represent cathode current Ic flowing at the corresponding dots formed at different intersection portions between the cathode electrode and the anode electrode.

The relationship between the gate-cathode $V_{GC}$ and the cathode current Ic may be varied in time depending on an accumulated operation time of a display (hereinafter, referred to as "temporal variation in characteristics") and may also be varied depending on dot position (hereinafter, referred to as "spatial variation in characteristics"), so that the emission brightness may vary in time and space (hereinafter, referred to as "brightness variation").

The temporal variation in characteristics due to accumulated operation time is believed to occur when contaminants are adhered or when the gate electrode or the emitter deteriorates due to use for a long period of time. Further, the temporal variation in characteristics varies depending on dots. The spatial variation in characteristics of dots is considered due to the variation in a dimension of a gate hole formed in the gate electrode or a cone shape of the emitter produced during the manufacturing process.

In order to solve the problem of brightness variation, there are employed a voltage control type that controls emission brightness by adjusting a voltage between a cathode electrode or an anode electrode or a current control type that controls emission brightness by adjusting a magnitude of a cathode current flowing in a dot directly related to the emission brightness to be controlled. Further, as a driving method suitable for the current control type, an active matrix type is employed. In the active matrix type, a circuit is added to each dot positioned at an intersection portion of a cathode electrode and a gate electrode and to thereby adjust a magnitude of a cathode current flowing in a dot.

[Patent Document 1]

Japanese Patent Laid-open Publication No. H9-305139

[Patent Document 2]

Japanese Patent Laid-open Publication No. 2000-173445

However, the active matrix type can be realized by adding circuits to respective dots of the display panel in a same semiconductor fabrication process during which the display panel is fabricated. Therefore, the active matrix type requires a high-level technique and a high manufacturing cost. Further, the display panel and the driving circuit are fabricated as a unit, so that the combination of the display and the driving circuit is restricted. Accordingly, a product cannot be made by adding a new driving circuit to a conventional display panel or by adding a new display panel to a conventional driving circuit and, also, a long period of time is required from designing to shipping of the product. Moreover, although a current needs to be controlled with high accuracy, it is difficult to secure sufficient current accuracy in a conventional circuit.

SUMMARY OF THE INVENTION

In view of the above, the present invention provides a driving circuit capable of driving a display panel without employing an active matrix type and a display having same.

In accordance with an aspect of the present invention, there is provided a driving circuit of a display panel for driving a first electrode of the display panel in which the first electrode and a second electrode arranged to cross each other.

The driving circuit includes a first current mirror circuit formed by connecting a gate of a first FET and a gate of a second FET; a current detecting resistor connected to a drain of the first FET, for detecting a magnitude of the current flowing in the first FET; and a differential amplifier having an output end connected to a gate of the first FET, a positive input end connected to a connection node between the first FET and the current detecting resistor, and a negative input end to which a current control signal for controlling a magnitude of the current flowing in the first FET is inputted.

The driving circuit further includes a second current mirror circuit formed by connecting a gate of a third FET connected in series to the second FET to a gate of a fourth FET; an analog switch device connected in series to the fourth FET and the first electrode; and a cathode address control unit for controlling the analog switch device to be a conductive state or a non-conductive state.

In the driving circuit of the display panel in accordance with the aspect of the present invention, there are provided the first and the second current mirror circuit and, also, the second FET of the first current mirror circuit is connected in series with the third FET of the second current mirror circuit. Accordingly, a current having a magnitude in accordance with the current flowing in the first FET can be made to flow into the fourth FET. Further, the magnitude of the current flowing in the first FET can be controlled in accordance with the magnitude of the current control signal. Moreover, the fourth FET and the analog switch device are connected in series to the first electrode, so that the analog switch device can be controlled to be in a conductive state or a non-conductive state by the cathode address control unit. As a consequence, it is possible to control a magnitude of a current flowing in the first electrode with high accuracy in accordance with a current control signal, and also possible to control a conductive state and a non-conductive state of the current by the cathode address control unit.

In accordance with another aspect of the present invention, there is provided a display including a display panel in which a plurality of first electrodes and a plurality of second electrodes are arranged to cross each other; a first driving circuit for driving the first electrodes of the display panel; and a second driving circuit for driving the second electrodes of the display panel.

The first driving circuit includes a first current mirror circuit formed by connecting a gate of a first FET to a gate of a second FET; a current detecting resistor connected to a drain of the first FET, for detecting a magnitude of a current flowing in the first FET; and a differential amplifier having an output end connected to a gate of the first FET, a positive input end connected to a connection node between the first FET and the current detecting resistor, and a negative input end to which a current control signal for controlling a magnitude of the current flowing in the first FET is inputted.

The first driving circuit further includes a second current mirror circuit formed by connecting a gate of a third FET connected to the second FET in series and gates of a plurality of fourth FETs; a plurality of analog switch devices connected in series with the first electrodes and the fourth FETs; and a cathode address control unit for controlling each of the analog switch devices to be a conductive state or a non-conductive state.

In the display in accordance with the aspect of the present invention, there are provided a plurality of first and second electrodes intersecting with each other. Therefore, the current at intersection portions can be controlled by the first and the second driving circuit. The first driving circuit has the first current mirror circuit and the second current mirror circuit. Further, the second FET of the first current mirror circuit is connected in series with the third FET of the second current mirror circuit. Accordingly, a current of a magnitude in accordance with the current flowing in the first FET can flow into each of a plurality of fourth FETs. Moreover, the magnitude of the current flowing in the first FET can be controlled in accordance with the current control signal. Furthermore, the fourth FETs and the analog switch devices are connected in series to the first electrode, so that the analog switch device can be controlled between a conductive state and a non-conductive state by the cathode address control unit. As a consequence, it is possible to control a magnitude of a current flowing in the first electrode with high accuracy in accordance with a current control signal, and also possible to control a conductive state and a non-conductive state of the current by the cathode address control unit.

In accordance with the driving circuit of the display panel of the present invention, the current flowing in the first electrode can be driven with high accuracy and, also, a display having no brightness variation can be performed in spite of the variation in characteristics of accumulated driving time and the variation in characteristics at dots. Further, in accordance with the display of the present invention, the current flowing in the first electrode can be driven with high accuracy; an image having no brightness variation can be obtained in spite of the variation in characteristics of accumulated driving time and the variation in characteristics of dots; and the current flowing in the intersection portions between the first electrode and the second electrode can be independently controlled in accordance with the brightness signal.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

The embodiments of the present invention will be described with reference to the accompanying drawings which form a part hereof.

Figure 1:
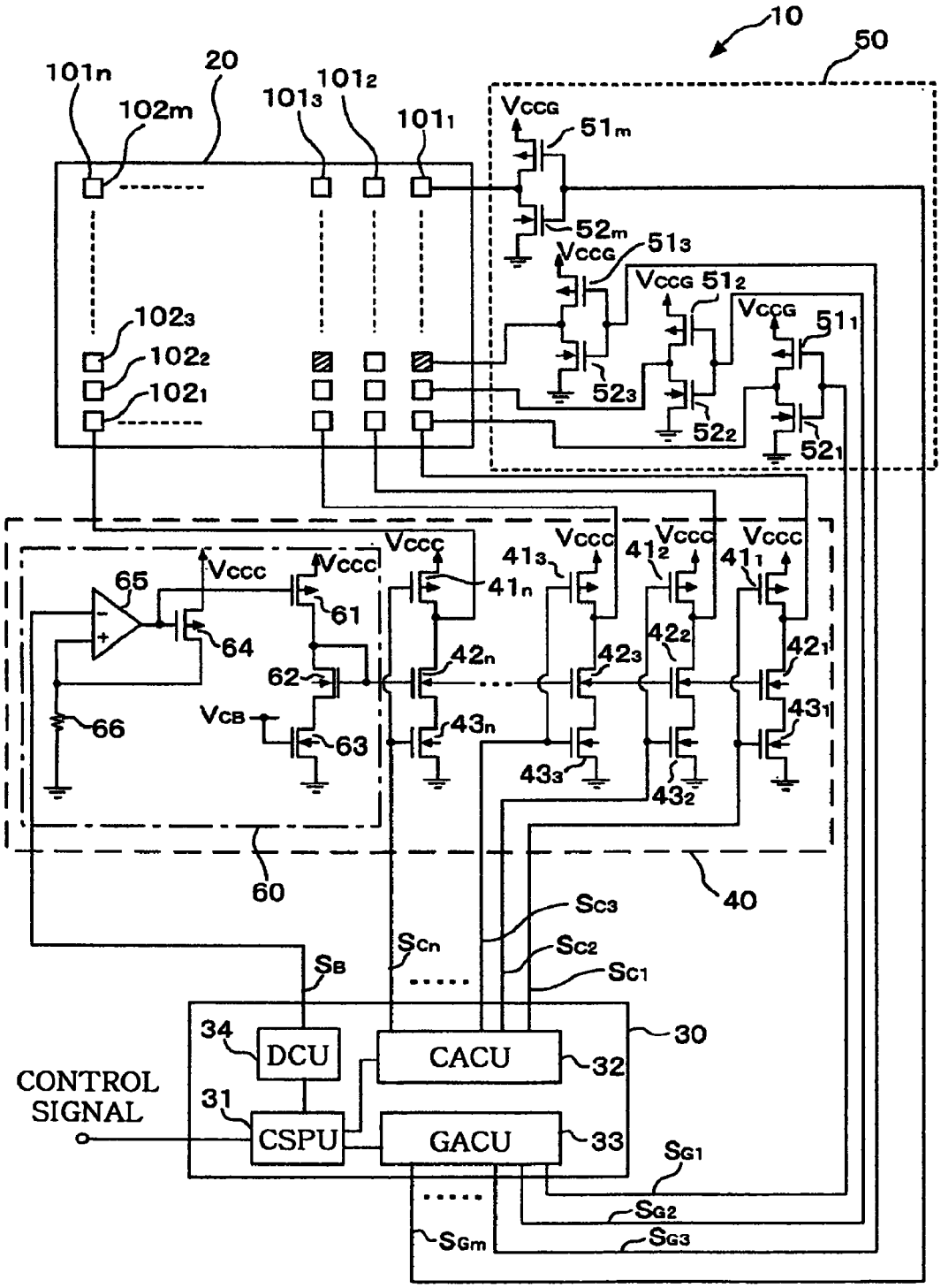
FIG. 1 shows a display in accordance with an embodiment of the present invention.

FIG. 1 shows a display 10 in accordance with an embodiment of the present invention. The display 10 includes a display panel 20, a driving unit controller 30, a cathode electrode driving unit 40 and a gate electrode driving unit 50. The driving unit controller 30, the cathode electrode driving unit 40 and the gate electrode driving unit 50 form a driving circuit. In the following, the display panel 20, the driving unit controller 30, the gate electrode driving unit 50 and the cathode electrode driving unit 40 will be described in that order. Thereafter, the operation of the display 10 will be explained.

Figure 13:
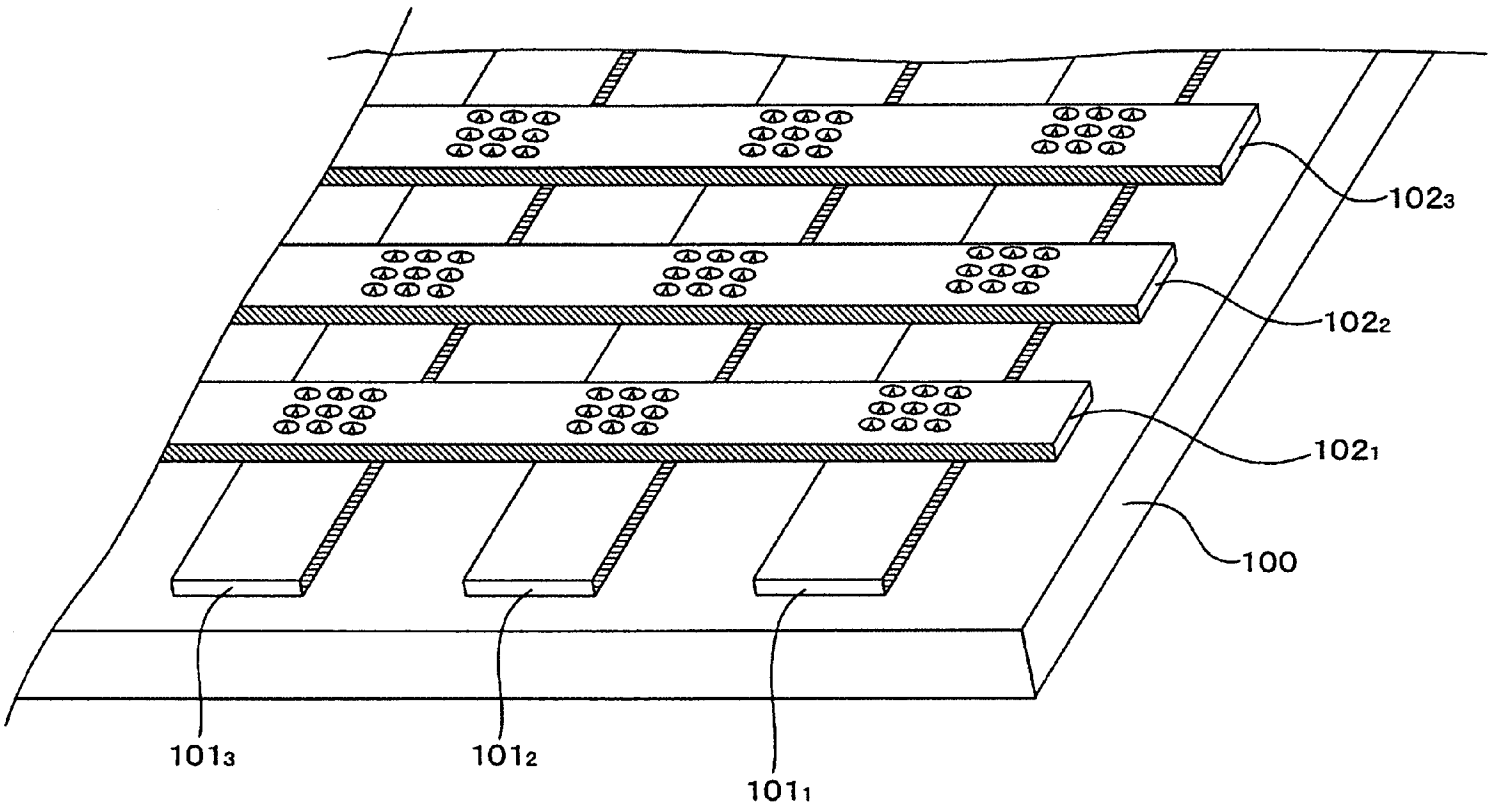
FIG. 13 (PRIOR ART)
FIG. 13 schematically shows a part of a display panel.
Figure 14:
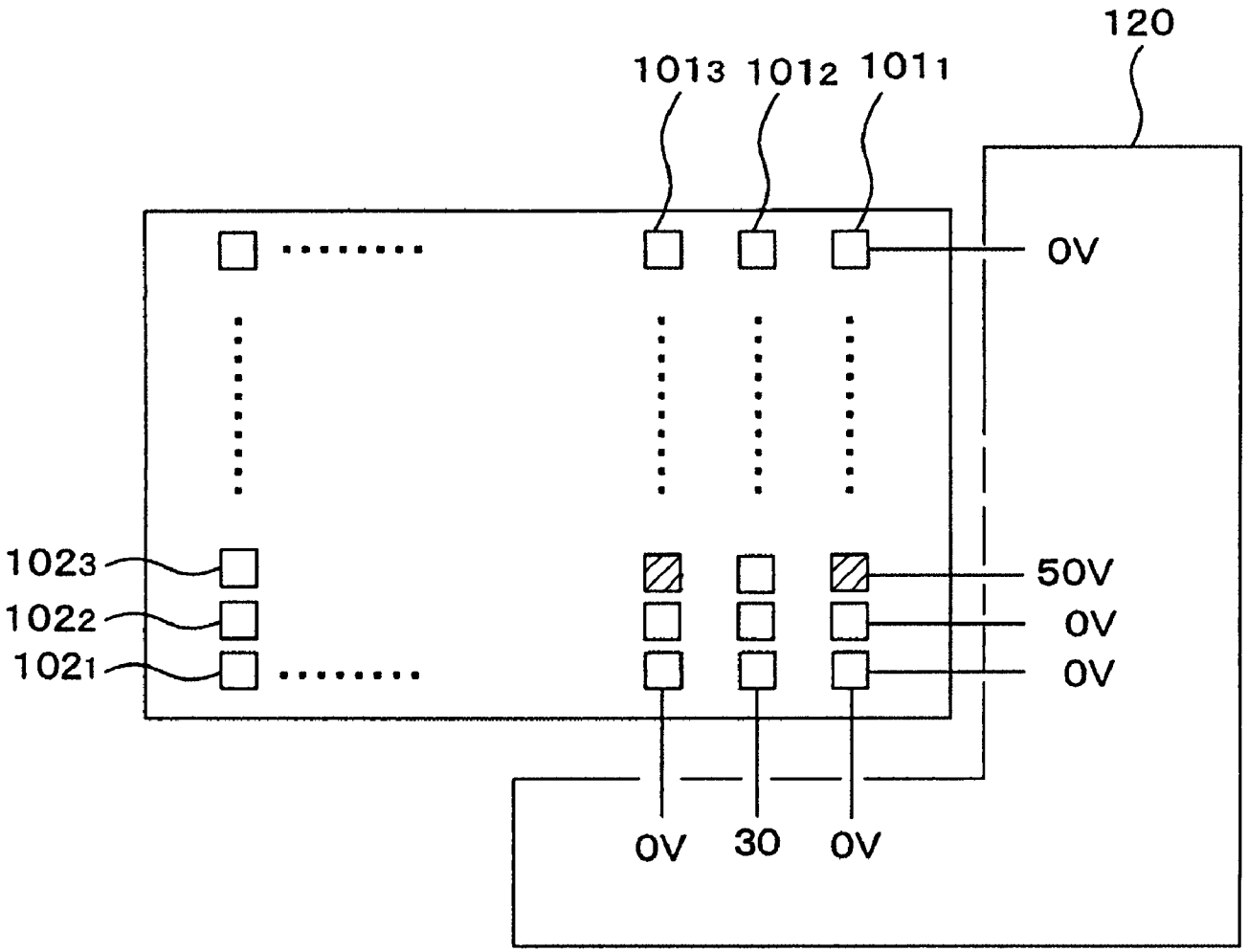
FIG. 14 (PRIOR ART)
FIG. 14 provides a conceptual diagram for explaining a method for driving the display panel.
Figure 15:
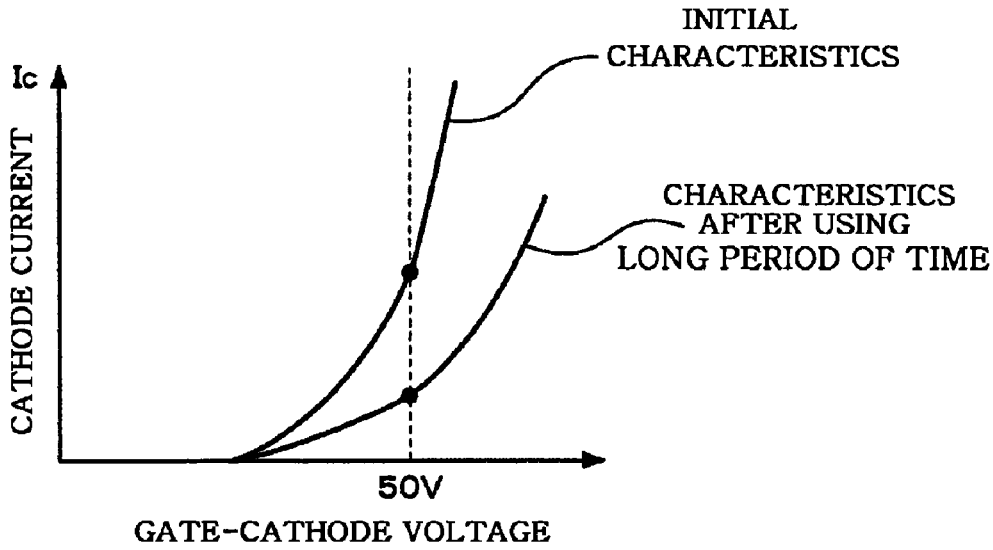
FIG. 15 (PRIOR ART)
FIG. 15 is a diagram for comparing initial characteristics and after-use characteristics of the display.
Figure 16:
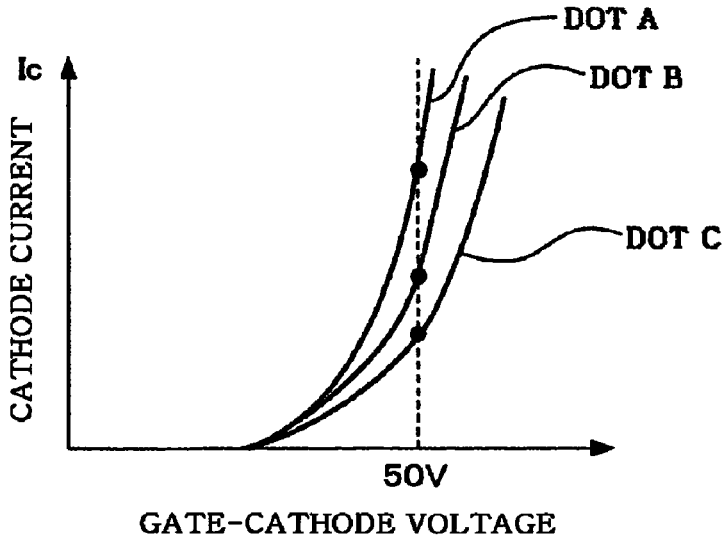
FIG. 16 (PRIOR ART)
FIG. 16 offers a diagram for comparing current emission performances at different dots of the display panel.

The display panel 20 has the same structure as that of the display panel shown in FIG. 13, so that parts of the common description thereof will be omitted. An n-number of cathode electrodes $\mathbf{101}_1$ to 101n are arranged in substantially parallel columns, and an m-number of gate electrodes $\mathbf{102}_1$ to $\mathbf{102}_m$ are arranged in substantially parallel rows. Here, n and m are integers that may be same or different. Further, the cathode electrodes and the gate electrodes are disposed to intersect with each other, and each intersection is provided with a dot that includes one or more emitters to form an FED. Although anode electrodes are not illustrated in FIG. 1, the display panel is provided with anode electrodes. Meanwhile, a display panel of an EL display is different from that of an FED in that the anode electrodes for collecting electrons are not provided. Apart from this, a display panel using an EL can also be configured as shown in FIG. 1. Moreover, terms used for the EL are different from those used for the FED. Specifically, a gate electrode of the FED is referred to as an anode electrode in the EL.

Hereinafter, the driving unit controller 30, the gate electrode driving unit 50 and the cathode electrode driving unit 40 forming the driving circuit will be described in that order.

The driving unit controller 30 of the driving circuit receives a control signal from an external device (not shown). The control signal may be either an analog signal or a digital signal, and is divided into a display address signal and a display signal by a control signal processing unit (CSPU) 31. The display signal contains brightness information, and is used for brightness control. Further, the display signal is transmitted to a display control unit (DCU) 34. The display control unit 34 generates a brightness signal $S_B$ in order to control a variable current source 60 of the cathode electrode driving unit 40 which will be described later. The brightness signal $S_B$ is produced based on the display signal and controls the emission brightness. The brightness signal $S_B$ is a current control signal that controls a magnitude of a current flowing in a PMOS 64 of the variable current source 60.

The display address signal includes information on a two-dimensional position where the information determined by the brightness signal $S_B$ is to be located in the display panel 20. The display address signal is transmitted to a cathode address control unit (CACU) 32 and a gate address control unit (GACU) 33. The cathode address control unit 32 generates cathode select signals $S_{C1}$ to $S_{Cn}$ that selects a cathode electrode row to be used for light emission. The gate address control unit 33 generates gate select signals $S_{G1}$ to $S_{Gm}$ for selecting a cathode electrode line to be used for light emission.

The gate electrode driving unit 50 includes P-MOSFETs (P-channel Metal Oxide Semiconductor Field Effect Transistors, hereinafter, referred to as "PMOSs") and N-MOSFETs (N-channel Metal Oxide Semiconductor Field Effect Transistors, hereinafter, referred to as "NMOSs"). PMOSs $\mathbf{51}_1$ to $\mathbf{51}_m$ and NMOSs $\mathbf{52}_1$ to $\mathbf{52}_m$ are provided in the gate electrode driving unit 50. A drain of a PMOS (e.g., PMOS $\mathbf{51}_1$) is connected to that of an NMOS (e.g., NMOS $\mathbf{52}_1$), and a gate electrode (e.g., gate electrode $\mathbf{102}_1$) is connected to a connection node of the drains thereof. Accordingly, the gate electrodes $102_1$ to $102_m$ are driven with the combination of the PMOSs $51_1$ to $51_m$ and the NMOSs $52_1$ to $52_m$. Further, a positive voltage $V_{CCG}$ is supplied to a source of each of the PMOSs $51_1$ to $51_m$, and a source of each of the NMOSs $52_1$ to $52_m$ is at ground potential. The P-MOSFET and the N-MOSFET are referred to as FET.

The gate of the PMOS (e.g., PMOS $51_1$) is connected to that of the NMOS (e.g., NMOS $52_1$), and a gate select signal (e.g., gate select signal $S_{G1}$) is applied to the connection de therebetween. Accordingly, the gate electrodes $102_1$ to $102_m$ are driven by the gate select signals $S_{G1}$ to $S_{Gm}$, respectively. Here, each of the gate select signals $S_{G1}$ to $S_{Gm}$ is a binary signal having a high level value and a low level value. When a gate select signal is at a high level, the PMOS is turned OFF and the NMOS is turned ON. On the other hand, when the gate select signal is at a low level, the corresponding PMOS becomes ON and the corresponding NMOS becomes OFF. That is, the PMOSs $51_1$ to $51_m$ and the NMOSs $52_1$ to $52_m$ of the gate electrode driving unit 50 serve as switch devices that switch between ON and OFF complementarily.

The cathode electrode driving unit 40 has PMOSs $41_1$ to $41_n$, NMOSs $42_1$ to $42_n$ and NMOSs $43_1$ to $43_n$. A drain of a PMOS (e.g., PMOS $41_1$) is connected to that of an NMOS (e.g., NMOS $42_1$), and a cathode electrode (e.g., cathode electrode $101_1$) is connected to a connection node therebetween. The cathode electrodes $101_1$ to $101_n$ are driven with a combination of PMOSs $41_1$ to $41_n$, NMOSs $42_1$ to $42_n$ and NMOSs $43_1$ to $43_n$. Further, a gate of the PMOS (e.g., PMOS $41_1$) is connected to that of the NMOS (e.g., NMOS $43_1$), and a cathode select signal (e.g., cathode select signal $S_{C1}$) is inputted to the connection node therebetween. As a consequence, the cathode electrodes $101_l$ to $101_n$ are controlled by the cathode select signals $S_{C1}$ to $S_{Cn}$, respectively.

Moreover, a positive voltage $V_{CCC}$ is supplied to each of the sources of the PMOSs $41_1$ to $41_n$. The drains of the NMOSs $43_1$ to $43_n$ are connected to sources of the NMOSs $42_1$ to $42_n$, respectively.

Figure 2:
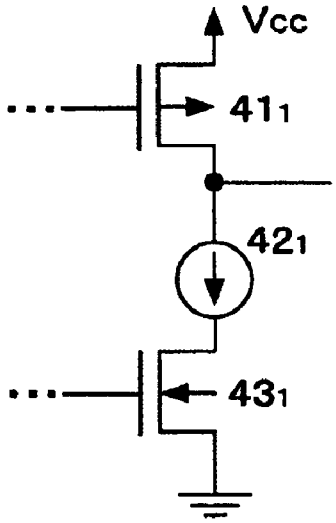
FIG. 2 describes a part of a principal portion of a driving circuit.

FIG. 2 explains connection relationship and functions of one PMOS and two NMOSs which form a part of a principal portion of the driving circuit by using the PMOS $41_1$ and the NMOSs $42_1$ and $43_1$ as an example. The PMOS $41_1$ and the NMOS $43_1$ serve as analog switch devices. That is, the PMOS $41_1$ is controlled to be ON (conductive state between the source and the drain of the PMOS $41_1$) or OFF (non-conductive state between the source and the drain thereof) by changing a potential of the gate of the PMOS $41_1$. Further, the NMOS $43_1$ is controlled to be ON or OFF (conductive or non-conductive state between the source and the drain of the NMOS $43_1$) by changing a potential of the gate of the NMOS $43_1$.

Here, as shown in FIG. 1, the gate of the PMOS $41_1$ and that of the NMOS $43_1$ are connected with each other and the cathode select signal $S_{c1}$ which has a high and a low value is inputted to the connection node between the PMOS $41_1$ and NMOS $43_1$. The voltage swing between the high and the low value of the cathode select signal $S_{c1}$ is large enough to drive the PMOS $41_1$ and the NMOS $43_1$ to be completely ON and OFF, or vice versa. Therefore, when the PMOS $41_1$ is ON, the NMOS $43_1$ is OFF. Further, when the PMOS $41_1$ is OFF, the NMOS $43_1$ is ON. That is, the PMOS $41_1$ and the NMOS $43_1$ serve as an analog switch device that controls whether or not an analog current having a predetermined analog value flows from the cathode electrode $101_1$.

Meanwhile, the NMOS $42_1$ serves as a current source. When the NMOS $43_1$ is ON and the PMOS $41_1$ is OFF, a current of a predetermined magnitude flows from the NMOS $42_1$ to the NMOS $43_1$. At this time, no current flows in the PMOS $41_1$ that is OFF, and the current from the cathode electrode $101_1$ connected to the drain of the NMOS $42_1$ flows into the drain of the NMOS $42_1$. Further, when the NMOS $43_1$ is OFF and the PMOS $41_1$ is ON, no current flows from the NMOS $42_1$ serving as the current source. This is because a path where a current of a predetermined magnitude flows from the NMOS $42_1$ is blocked. In this case, the PMOS $41_1$ is made to be ON in order to clamp a potential of the cathode electrode $101_1$ to a voltage Vccc and prevent the potential of the cathode electrode $101_1$ from being left undefined. Especially, in a display using an FED, a high voltage of 3 KV is applied to the anode electrode, so that it is preferable to prevent a high voltage from being applied to the cathode electrode $01_1$. The above description is also applied to the operations of the sets of the PMOS $41_2$ and the NMOSs $42_2$ and $43_2$, the PMOS $41_3$ and the NMOSs $42_3$ and $43_3$, . . . , and the PMOS $41_n$ and the NMOSs $42_n$ and $43_n$ which operate in a same way.

Figure 3:
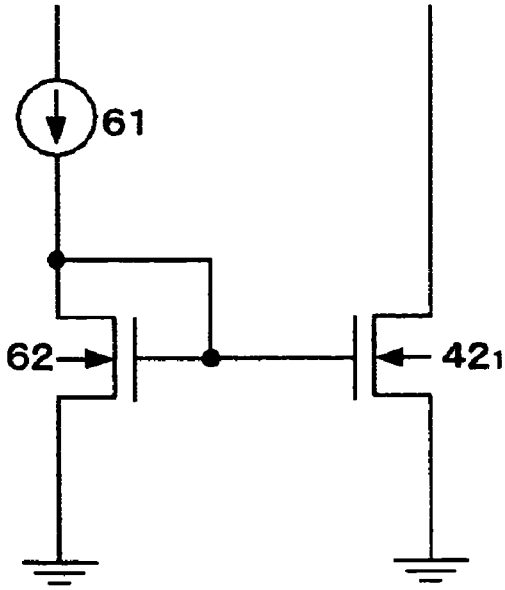
FIG. 3 illustrates another part of the principal portion of the driving circuit.

FIG. 3 explains how the NMOS $42_1$ forming another part of the principal portion of the driving circuit functions as a current source. In FIG. 3, the NMOS 63 connected to the NMOS 62 and the NMOS $43_1$ connected to the NMOS $42_1$ are omitted. FIG. 3 illustrates the so-called current mirror circuit. That is, the gate of the NMOS 62 is connected to that of the NMOS $42_1$. When the NMOS 62 and the NMOS $42_1$ have same characteristics, a magnitude of a current flowing between the drain and the source of the NMOS $42_1$ is same as that of the current flowing between the drain and the source of the NMOS 62.

Figure 4:
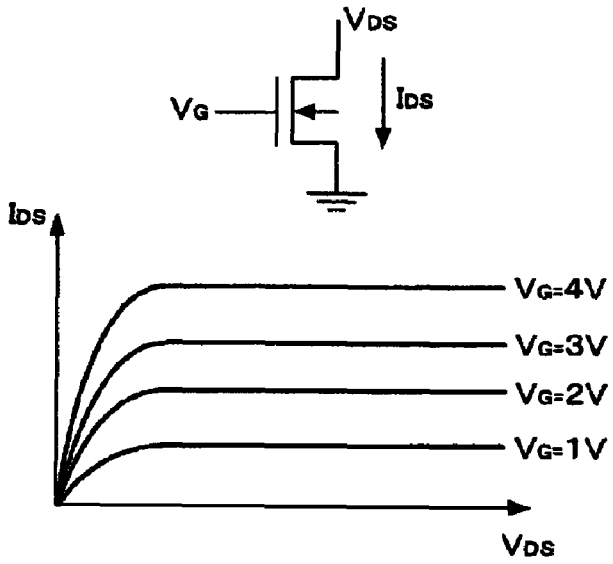
FIG. 4 provides a graph showing characteristics of an N channel MOSFET.

The reason thereof will be described hereinafter with reference to FIG. 4. FIG. 4 is a graph showing the characteristics of the NMOS. A vertical axis indicates a current Ids flowing between the drain and the source, and a horizontal axis indicates a voltage Vds between the drain and the source. The voltage $V_G$ is a potential of the gate. In this case, since the source is grounded, the voltage $V_G$ is a voltage between the gate and the source. In the so-called saturated region, the current Ids is determined by a magnitude of a voltage $V_G$, and is not dependent on the voltage Vds. The drain and the gate of the NMOS 62 are connected, so that the NMOS 62 operates in the saturated region. Further, the NMOS 61 serving as a current source is connected to the drain of the NMOS 62, so that a gate potential required to flow a current from the NMOS 61 between the drain and the source of the NMOS 62 is generated in the gate of the NMOS 62. Therefore, the current of a same magnitude as that from the current source (NMOS 61) flows in the NMOS $42_1$ having a gate potential of a same magnitude as that of the NMOS 62.

Figure 5:
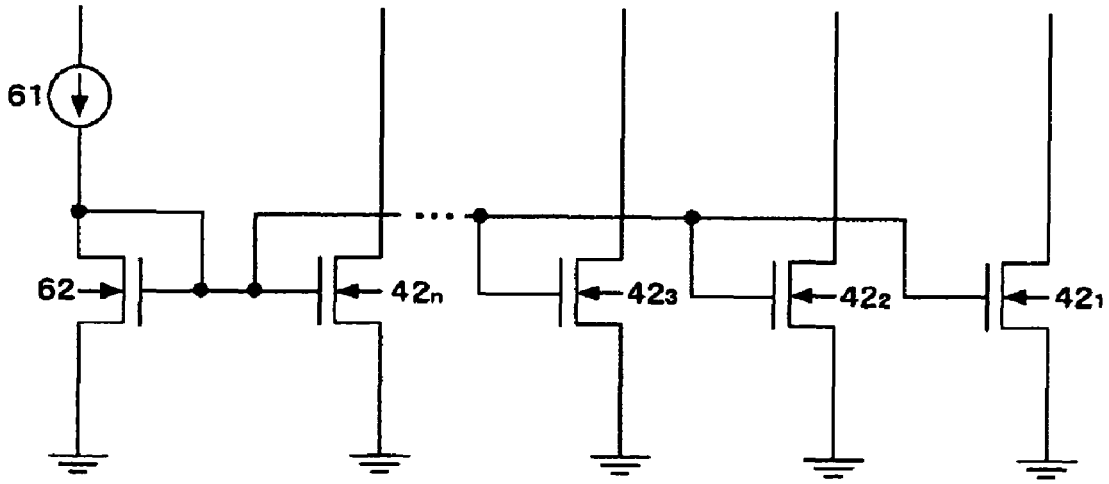
FIG. 5 depicts still another part of the principal portion of the driving circuit.

FIG. 5 is an enlarged view of the NMOSs $42_1$ to $42_n$ in FIG. 1 which forms another part of the principal portion of the driving circuit. In FIG. 5, the NMOSs $43_1$ to $43_n$ connected to sources of the NMOSs $42_1$ to $42_n$ are omitted. As can be seen from FIG. 5, the gates of the NMOS $42_1$ to $42_n$ are connected in parallel to the gate of the NMOS 62, so that a current of a same magnitude can be made to flow between the drains and the sources of the NMOSs $42_1$ to $42_n$. Further, a current of a same magnitude can be made to flow into the cathode electrodes $101_1$ to $101_n$ connected to the drains of the NMOSs $42_1$ to $42_n$.

Hereinafter, the relationship between the NMOS 63 and the NMOSs $43_1$ to $43_n$ will be described. As set forth above, the NMOSs $43_1$ to $43_n$ serve as analog switch devices. In an actual operation of each analog switch device, however, drain-source voltages are generated between drains and sources of the NMOSs 431 to 43n. Therefore, the gate-source voltages of the NMOSs $42_1$ to $42_n$ are reduced by the drain-source voltages, respectively, so that the gate-source voltage of the NMOS 62 becomes different from those of the NMOS $\mathbf{42}_1$ to $\mathbf{42}_n$ if the source of the NMOS 62 is grounded. Accordingly, the current mirror circuit does not operate properly. In the circuit shown in FIG. 1, therefore, the NMOS 63 is provided to improve the accuracy of the current mirror. The voltage $V_{CB}$ applied to the gate of the NMOS 63 is set to the high-level voltage of the cathode select signals $S_{C1}$ to $S_{Cn}$ respectively applied to the NMOS $\mathbf{43}_1$ to $\mathbf{43}_n$. Therefore, the drain-source voltage of the NMOS 63 becomes the same as that of the drain-source voltage when the NMOS $\mathbf{43}_1$ to $\mathbf{43}_n$ are ON. As a result, the current mirror circuit can operate with high accuracy even when the NMOSs $\mathbf{43}_1$ to $\mathbf{43}_n$ are provided.

The NMOSs $\mathbf{43}_1$ to $\mathbf{43}_n$ serve as analog switch devices for disconnecting current paths through which the cathode electrodes are connected in series with the NMOSs $\mathbf{42}_1$ to $\mathbf{42}_n$ serving as current sources. Thus, connection between the NMOSs may be altered as follows: The drains of the NMOSs $\mathbf{431}_1$ to $\mathbf{431}_n$ are connected to the drains of the PMOSs $\mathbf{41}_1$ to $\mathbf{41}_n$, and the sources thereof are connected to the drains of the NMOSs $\mathbf{42}_1$ to $\mathbf{42}_n$ whose sources are grounded. Further, the cathode electrodes are connected to the connection nodes between the drains of the PMOSs $\mathbf{41}_1$ to $\mathbf{41}_n$ and those of the NMOSs $\mathbf{43}_1$ to $\mathbf{43}_n$. When such a connection type is employed, the NMOSs $\mathbf{43}_1$ to $\mathbf{43}_n$ do not affect the gate-source voltage of the NMOSs $\mathbf{42}_1$ to $\mathbf{42}_n$ and, hence, there is no need to employ the NMOS 63 and therefore, the NMOS 63 can be omitted.

The cathode electrode driving unit 40 includes the variable current source 60. The variable current source 60 has the aforementioned PMOSs 61 and 64, NMOSs 62 and 63, the differential amplifier 65 and the resistor 66. The variable current source 60 has a function of setting a current level of the PMOS 61 serving as a current source that generates a current of a reference magnitude. The gate of the PMOS 64 is connected to that of the PMOS 61, forming another current mirror circuit. Accordingly, the magnitude of the current flowing between the source and the drain of the PMOS 64 becomes the same as that of the current flowing between the source and the drain of the PMOS 61.

The magnitude of the current flowing between the source and the drain of the PMOS 64 is detected in terms of a voltage by the resistor 66 connected to the drain of the PMOS 64, and then is inputted into a positive input end of the differential amplifier 65. Further, a brightness signal $S_B$ is inputted into a negative input end of the differential amplifier 65, so that the voltage of the resistor 66 is feedback-controlled to be made same as that of the brightness signal $S_B$ as a reference value. Here, both end voltages of the resistor 66 are obtained by multiplying the current flowing in the resistor 66 by the resistance of the resistor 66, so that the magnitude of the current flowing in the resistor 66, i.e., the magnitude of the current flowing between the source and the drain of the PMOS 64, can be controlled by the brightness signal $S_B$.

By combining the two current mirrors, the magnitude of the current flowing in the cathode electrodes $\mathbf{101}_1$ to $\mathbf{101}_n$ can be controlled with high accuracy by the brightness signal $S_B$. Moreover, a magnitude of current flowing in a single cathode electrode is considerably small, e.g., about 1 μA.

Hereinafter, the operation of the display 10 will be described.

Figure 6:
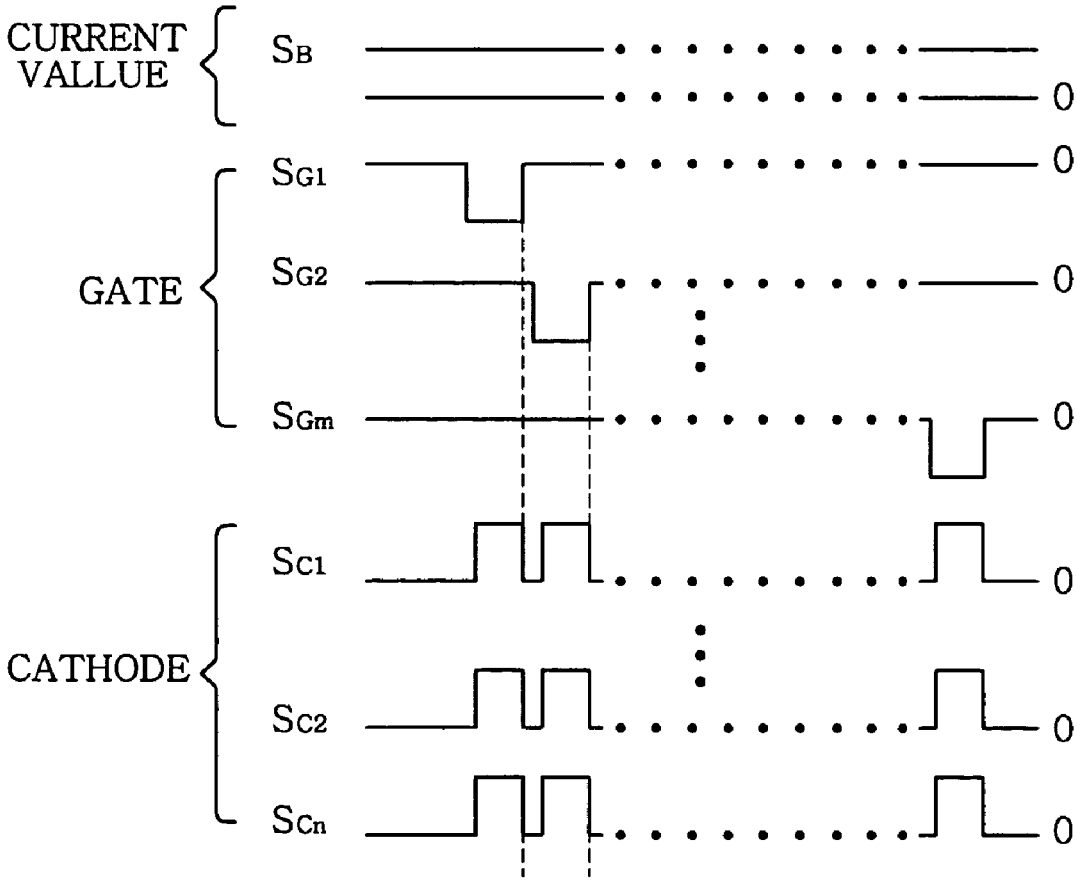
FIG. 6 presents a diagram explaining an operation of the display.
Figure 7:
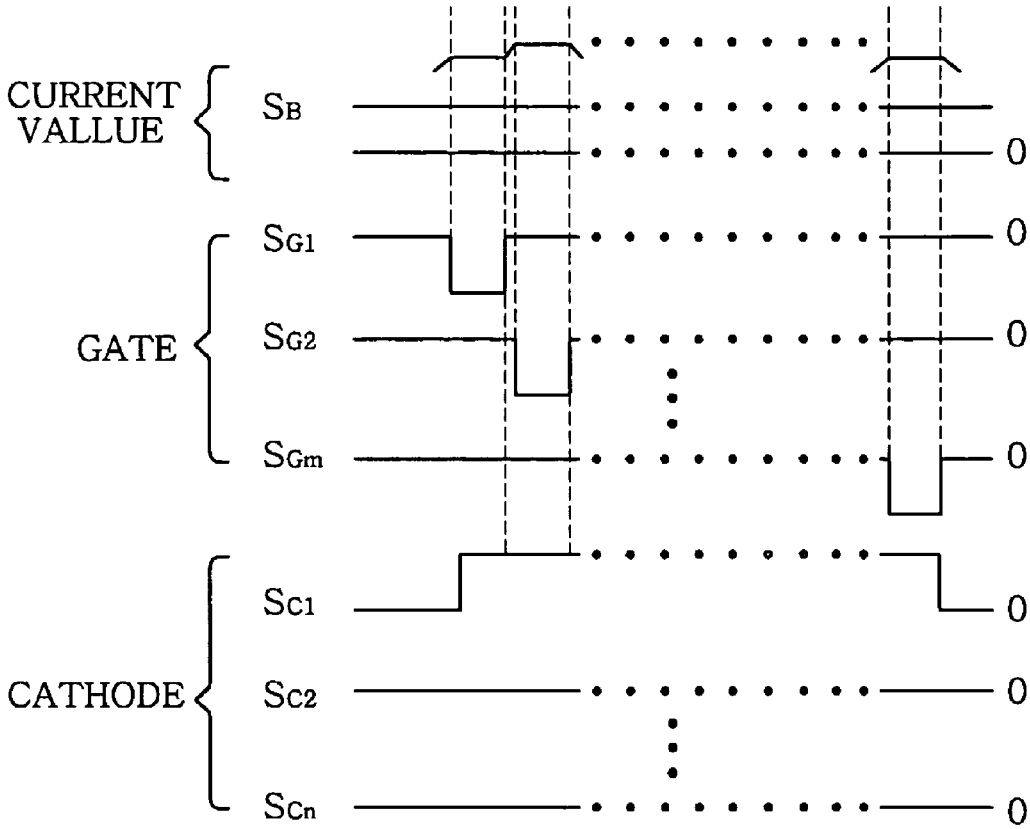
FIG. 7 provides another diagram explaining the operation of the display.

FIGS. 6 and 7 explain an operation of the display 10 with reference to the signals of each unit. FIG. 6 illustrates a case where all the dots are on, i.e., each of the dots emits a same amount of electrons and each phosphor corresponding to each dot emit light of a same brightness. From the top of FIG. 6, there are illustrated a current value flowing in the cathode electrode controlled by the brightness signal $S_B$, gate select signals for controlling the gate electrodes and cathode select signals for controlling the cathode electrodes. In FIG. 6, the gate select signals $S_{G1}$, $S_{G2}$ and $S_{Gm}$ and the cathode select signals $S_{C1}$, $S_{C2}$ and $S_{Cn}$ are illustrated, whereas the remaining gate select signals and the remaining cathode select signals are omitted. Moreover, a horizontal axis of each signal indicates time.

Referring to FIG. 6, the brightness signal $S_B$ maintains a constant voltage (ensuring perceivable brightness), so that the magnitude of the current flowing between the source and the drain of the PMOS 64 is controlled to be set at a predetermined level constantly. In that state, while the gate select signal $S_{g1}$ is low, all of the cathode select signals $S_{c1}$ to $S_{cn}$ are high, so that NMOSs $\mathbf{43}_1$ to $\mathbf{43}_n$ become ON. Therefore, a same amount of current flows in each of cathode electrodes $\mathbf{101}_1$ to $\mathbf{101}_n$, whereby whole surface of the display panel 20 emits lights of a same brightness.

FIG. 7 depicts a control method of sequentially changing the brightness signal $S_B$ and setting brightness in two-dimensional coordinates on a display panel in accordance with the brightness signal $S_B$.

In FIG. 7, the level of the brightness signal $S_B$ changes whenever each dot is selected, and the magnitude of the current flowing between the source and the drain of the PMOS 64 is controlled to vary in accordance with the brightness signal $S_B$. In that state, the cathode signal $S_{c1}$ only is high while the gate signal $S_{g1}$ is low, the current can flow only in the cathode electrode $\mathbf{101}_1$ and, also, the current in accordance with the brightness signal $S_B$ flows in the dot of the intersection of the gate electrode $\mathbf{102}_1$ and the cathode electrode $\mathbf{101}_1$.

Next, if only the cathode select signal $S_{c1}$ is high while the gate select signal $S_{g2}$ is low, the current in accordance with the brightness signal $S_B$ flows in the dot of the intersection of the gate electrode $\mathbf{102}_2$ and the cathode electrode $\mathbf{101}_1$. With such sequential scanning, it is possible to sequentially and separately control the current values of the respective dots disposed over the entire two-dimensional surface of the display panel 20, and also possible to control the brightness of the phosphor of the corresponding dot to a desired level. That is, a desired two-dimensional image can be displayed.

Figure 8:
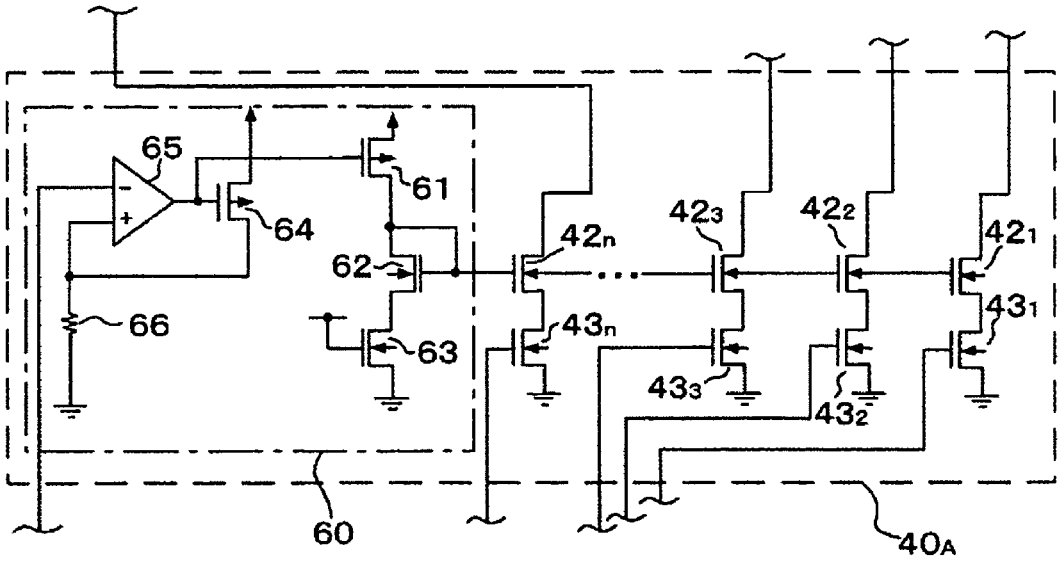
FIG. 8 shows a modification of the driving circuit.

FIG. 8 describes a modification of the driving circuit. In FIG. 8, a circuit 40A is the modification of the cathode electrode driving circuit 40 in FIG. 1. The other parts that are not shown in FIG. 8 are the same as those shown in FIG. 1. In the circuit in FIG. 8, the PMOS $\mathbf{41}_1$ to $\mathbf{41}_n$ are not provided. This modified circuit still has a same current driving effect as the original circuit in FIG. 1. As described above, however, when NMOSs $\mathbf{43}_1$ to $\mathbf{43}_n$ are OFF, each of the cathode electrodes $\mathbf{101}_1$ to $\mathbf{101}_n$ may have an undefined voltage value. Such case is not preferred in FED using high voltage of about 3 KV in the display apparatus. However, the above circuit can be suitably employed in an EL in which no high voltage is applied to anode electrodes.

Figure 9:
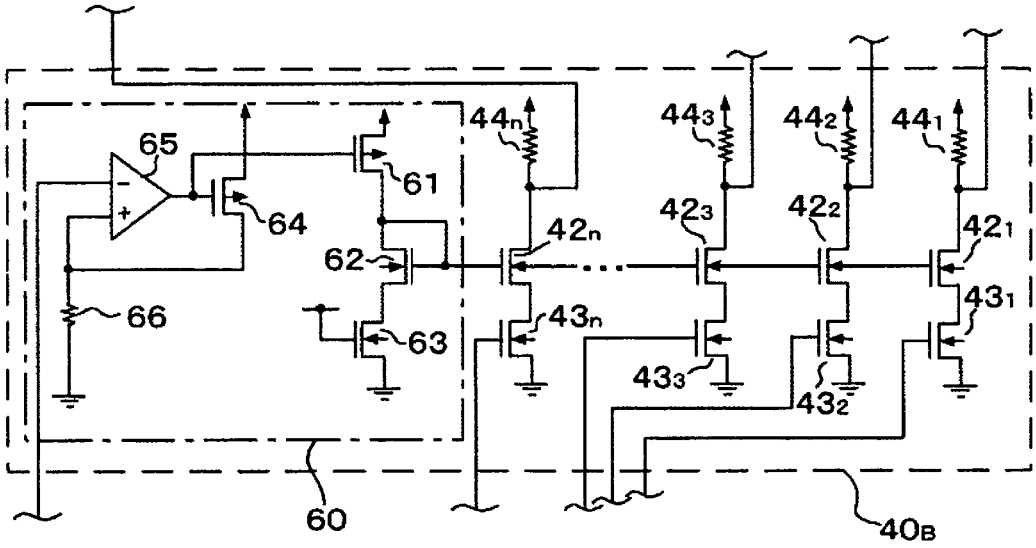
FIG. 9 illustrates another modification of the driving circuit.
Figure 10:
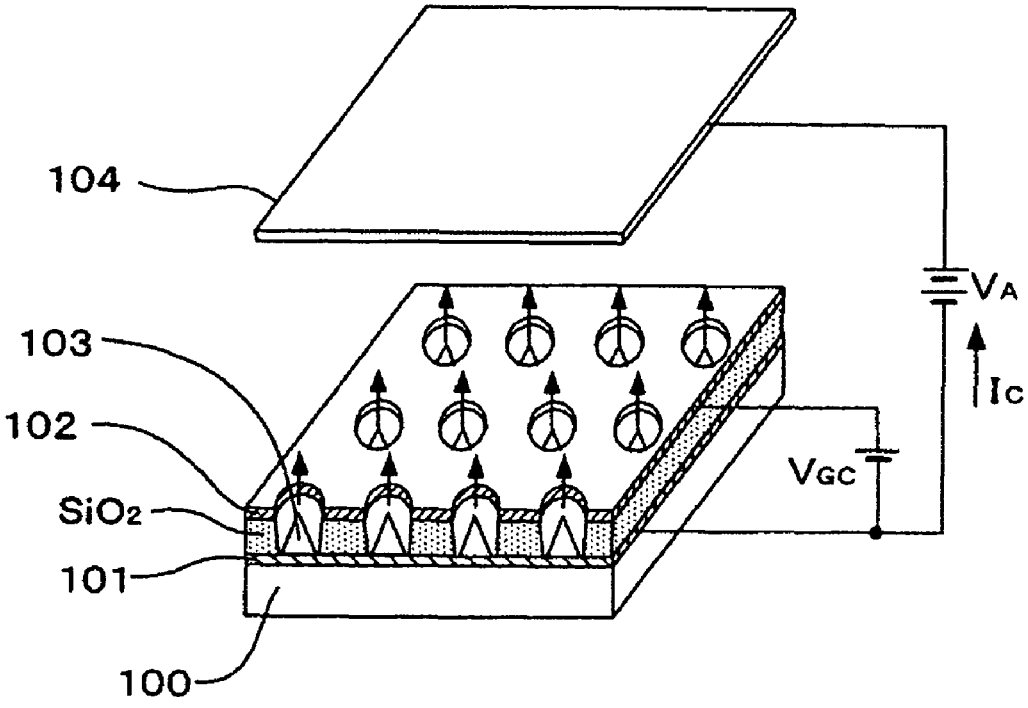
FIG. 10 (PRIOR ART)
FIG. 10 offers a cross sectional view of a spindt type FED.
Figure 11:
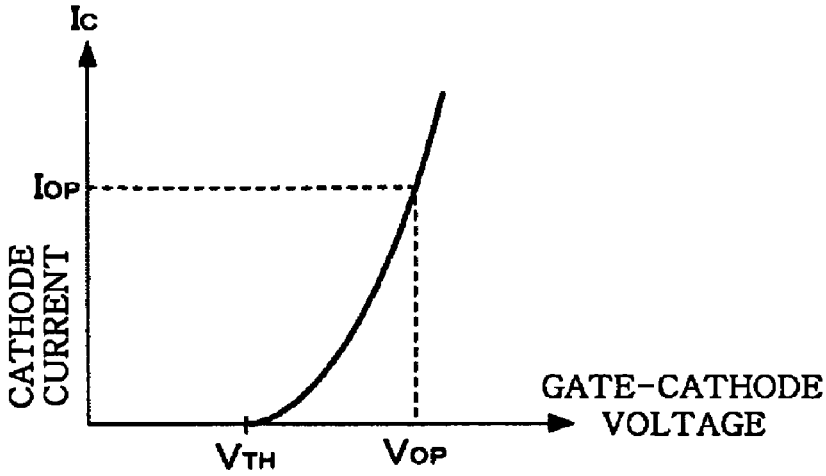
FIG. 11 (PRIOR ART)
FIG. 11 depicts a cathode current with respect to a gate-cathode voltage of the spindt type FED.
Figure 12:
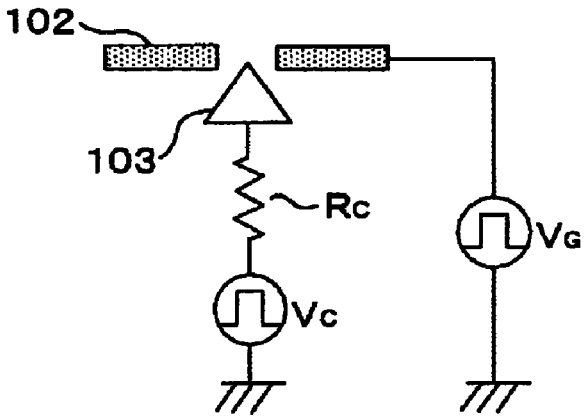
FIG. 12 (PRIOR ART)
FIG. 12 describes the spindt type FED as an equivalent circuit.

FIG. 9 shows another modification of the driving circuit. In FIG. 9, a circuit 40B is the modification of the cathode electrode driving circuit 40 in FIG. 1. The other parts that are not shown in FIG. 9 are the same as those shown in FIG. 1. In the circuit in FIG. 9, resistors $\mathbf{44}_1$ to $\mathbf{44}_n$ are installed instead of the PMOSs $\mathbf{41}_1$ to $\mathbf{41}_n$. In that case, it is possible to prevent the voltage of the cathode electrodes from being left undefined. However, currents flowing in the resistors $\mathbf{44}_1$ to $\mathbf{44}_n$ flow in the NMOSs $\mathbf{42}_1$ to $\mathbf{42}_n$ serving as current sources, respectively, and, thus, the current errors need to be reduced by increasing the resistances of the resistors $\mathbf{44}_1$ to $\mathbf{44}_n$.

The principal portion of the driving circuit of the display panel in accordance with the above embodiment will be described hereinafter. In the following description, an arbitrary cathode electrode is indicated as the cathode electrode $\mathbf{101}_1$; an NMOS connected to the cathode electrode 101 is indicated as the NMOS 42; and the NMOS connected to the NMOS 42 is indicated as the NMOS 43.

This driving circuit is characterized by the cathode electrode driving unit 40 (first electrode driving unit) connected to the cathode electrode 101 (first electrode) of the display panel 20. The cathode electrode driving unit 40 has the first current mirror circuit fabricated by connecting the gate of the PMOS 64 (first FET) and the gate of the PMOS 61 (second FET) and the second current mirror circuit fabricated by connecting the gate of the NMOS 62 (third FET) and the gate of the NMOS 42 (fourth FET).

The gate of the PMOS 64 (first FET) is connected to an output end of the differential amplifier 65. Further, the connection node between the drain of the PMOS 64 and the resistor 66 (current detecting resistor) is connected to a positive input end of the differential amplifier 65, and the brightness signal $S_B$ is inputted into a negative input end of the differential amplifier 65. With this connection, the current flowing in the PMOS 64 is detected in terms of a voltage by the register 66, and a feedback loop for controlling the detected voltage from the resister 66 to be made same as the brightness signal $S_B$ is formed. As a result, the magnitude of the current flowing in the PMOS 64 is in accordance with the brightness signal $S_B$. As a consequence, the PMOS 64 serves as a reference current source.

The PMOS 61 of the first current mirror is connected in series with the NMOS 62 of the second current mirror. By employing such a connection, the current of a same magnitude as that of the current flowing in the PMOS 61 (second FET) is made to flow in the NMOS 62 (third FET).

Moreover, the NMOS 42 (fourth FET), the NMOS 43 (analog switch device) and the cathode electrode 101 are connected in series. Further, there is provided the cathode address control unit 32 that controls the NMOS 43 to be ON (conductive state) or OFF (non-conductive state). By employing such a connection, the current having a magnitude in accordance with a magnitude of the current from the reference current source can be made to flow to the cathode electrode $\mathbf{101}_1$ when the NMOS 43 is ON. Meanwhile, the current can be made not to flow in (the cathode electrode 101 when the NMOS 43 is OFF.

By employing the above driving circuit to the display, the current flowing in the cathode electrode 101 can be driven with high accuracy and, also, an image having no brightness variation can be obtained in spite of the temporal variation in characteristics and the spatial variation in characteristics.

Moreover, when the driving circuit is employed to the display, the temporal variation in characteristics does not cause the brightness variation. As a result, the durable time of the display can be prolonged.

The principal portion of the display in accordance with the above embodiment will be described hereinafter. This display has the display panel 20 that displays an image on a two-dimensional surface and a driving circuit that drives the display panel.

The display panel 20 has the plurality of cathode electrodes (first electrode) arranged in substantially parallel relationship and the plurality of gate electrodes (second electrode) arranged in substantially parallel relationship, the gate electrodes and the cathode electrodes being disposed substantially perpendicular to each other. By employing such a structure, in the display using an FED, the electrons are emitted from the intersections of the gate electrodes and the cathode electrodes. Further, the electron emission can be controlled by the driving circuit that controls the gate electrodes and the cathode electrodes.

In the display using an EL, respective EL devices are arranged in a two-dimensional matrix pattern. Moreover, anode electrodes of the ELs in one row or column of the two-dimensional matrix are connected to each other, thus forming anode electrodes in one direction of the two-dimensional matrix (second electrode). Cathode electrodes of the ELs in column or row of the two-dimensional matrix are connected to each other, thus forming cathode electrodes in the other direction of the two-dimensional matrix (first electrodes). Accordingly, the EL devices disposed at the intersections of the anode electrodes and the cathode electrodes emit lights, and the emission can be controlled by the driving circuit for controlling the anode electrodes and the cathode electrodes.

The driving circuit is characterized by the cathode electrode driving unit 40 (first electrode driving unit) connected to the cathode electrodes $\mathbf{101}_1$ to $\mathbf{101}_n$ (a plurality of first electrodes) of the display panel 20. The cathode electrode driving unit 40 has the first current mirror circuit fabricated by connecting the gate of the PMOS 64 (first FET) and the gate of the PMOS 61 (second FET) and the second current mirror circuit fabricated by connecting the gate of the NMOS 62 (third FET) and those of the NMOSs $\mathbf{42}_1$ to $\mathbf{42}_n$ (a plurality of FETs).

The gate of the PMOS (first FET) is connected to an output end of the differential amplifier 65. Further, the connection node between the drain of the PMOS 64 and the resistor 66 (current detecting resistor) is connected to a positive input end of the differential amplifier 65, and the current control signal is inputted into a negative input end of the differential amplifier 65. With this connection, the current flowing in the PMOS 64 is detected in terms of a voltage by the resister 66, and a feedback loop for controlling the detected voltage by the resister 66 to be same as that of the current control signal is formed. As a result, the magnitude of the current flowing in the PMOS 64 is in accordance with the current control signal, i.e. the brightness signal $S_B$. As a consequence, the PMOS 64 serves as a reference current source.

The PMOS 61 of the first current mirror is connected in series with the NMOS 62 of the second current mirror. By employing such a connection, the current having a magnitude same as that of the current flowing in the PMOS 61 (second FET) can flow in the NMOS 62 (third FET).

Moreover, the NMOSs $\mathbf{42}_1$ to $\mathbf{42}_n$ (FETs) are connected in series with the NMOSs $\mathbf{43}_1$ to $\mathbf{43}_n$ (analog switch devices) and the cathode electrodes $\mathbf{101}_1$ and $\mathbf{101}_n$ (a plurality of first electrodes) , respectively. Further, there is provided the cathode address control unit 32 that controls the NMOSs $\mathbf{43}_1$ to $\mathbf{43}_n$ to be ON (conductive state) or OFF (non-conductive state). By employing such a connection, by having at least one of the NMOSs $\mathbf{43}_1$ to $\mathbf{43}_n$ (analog switch devices) to be ON, a current having a magnitude in accordance with a magnitude of the reference current source can be made to flow in the cathode electrode connected in series to the analog switch device. Further, by having at least one of the NMOSs $\mathbf{43}_1$ to $\mathbf{43}_n$ (analog switch devices) to be OFF, the current can be made not to flow in the cathode electrode connected in series to the analog switch devices.

By employing the above driving circuit to the display, the current flowing in the cathode electrode 101 can be driven with high accuracy and, also, an image having no brightness variation can be obtained in spite of the temporal variation in characteristics and the spatial variation in characteristics.

Moreover, when the driving circuit is employed in the display, the temporal variation in characteristics does not cause the brightness variation. As a result, the durable time of the display can be prolonged.

In accordance with the present invention, there is employed a display panel in which cathode electrodes and gate electrodes (anode electrode in case of EL) are disposed to intersect with each other. Further, by connecting the driving circuits to the respective end portions of the cathode electrodes and the gate electrodes (anode electrodes in case of EL) instead of providing circuits at the intersections thereof, the current flowing in each of the dots can be controlled in accordance with the brightness signal contained in the cathode electrode control signal. Accordingly, the variety of the combination type of the display panel and the driving circuit can be increased, and the application capability becomes improved compare to the case of applying the active matrix type.

While the invention has been shown and described with respect to the embodiments, it will be understood by those skilled in the art that various changes and modification may be made without departing from the scope of the invention as defined in the following claims.

What is claimed is:

1. A driving circuit of a display panel for driving a first electrode of the display panel in which the first electrode and a second electrode arranged to cross each other, comprising:

a first current mirror circuit formed by connecting a gate of a first FET and a gate of a second FET;

a current detecting resistor connected to a drain of the first FET, for detecting a magnitude of the current flowing in the first FET;

a differential amplifier having an output end connected to a gate of the first FET, a positive input end connected to a connection node between the first FET and the current detecting resistor, and a negative input end to which a current control signal for controlling a magnitude of the current flowing in the first FET is inputted;

a second current mirror circuit formed by connecting a gate of a third FET connected in series to the second FET to a gate of a fourth FET;

an analog switch device connected in series to the fourth FET and the first electrode; and a cathode address control unit for controlling the analog switch device to be a conductive state or a non-conductive state.

2. The driving circuit of a display panel of claim 1, wherein a drain of the fourth FET is connected to the first electrode; a source of the fourth FET is connected to the analog switch device; and a source of the third FET is connected to a fifth FET for controlling a voltage drop of the third FET to be same as that of the analog switch device in the conductive state.

3. The driving circuit of the display panel of claim 2, further comprising a sixth FET connected to the first electrode, for applying a specific voltage to the first electrode when the analog switch device is in the non-conductive state.

4. The driving circuit of the display panel of claim 1, wherein a plurality of the fourth FETs and a plurality of the analog switch devices are formed to correspond, and the cathode address control unit controls each of the plurality of analog switch devices between a conductive state and a non-conductive state.

5. A display comprising:

a display panel in which a plurality of first electrodes and a plurality of second electrodes are arranged to cross each other;

a first driving circuit for driving the first electrodes of the display panel; and a second driving circuit for driving the second electrodes of the display panel, wherein the first driving circuit includes:

a first current mirror circuit formed by connecting a gate of a first FET to a gate of a second FET;

a current detecting resistor connected to a drain of the first FET, for detecting a magnitude of a current flowing in the first FET;

a differential amplifier having an output end connected to a gate of the first FET, a positive input end connected to a connection node between the first FET and the current detecting resistor, and a negative input end to which a current control signal for controlling a magnitude of the current flowing in the first FET is inputted;

a second current mirror circuit formed by connecting a gate of a third FET connected to the second FET in series and gates of a plurality of fourth FETs;

a plurality of analog switch devices connected in series with the first electrodes and the fourth FETs; and a cathode address control unit for controlling each of the analog switch devices to be a conductive state or a non-conductive state.

6. The display of claim 5, wherein the current control signal is a brightness signal for controlling emission brightness of the display panel.

* * * * *